US005601198A

United States Patent [19]

Reed

[11] Patent Number: 5,601,198

[45] Date of Patent: Feb. 11, 1997

[54] FLEXIBLE BARRIER FOR A SHELF

[76] Inventor: Doris L. Reed, 2816 SW. 300th Pl., Federal Way, Wash. 98023

[21] Appl. No.: 353,716

[22] Filed: Dec. 12, 1994

[51] Int. Cl.[6] ..... A47F 7/00

[52] U.S. Cl. ..... 211/183

[58] Field of Search ..... 211/183, 180, 211/153, 134, 88; 160/327, 328, 354, 368.1, 369, 371; 312/210, 213, 3, 4, 5

[56] References Cited

U.S. PATENT DOCUMENTS

| | | | |
|---|---|---|---|
| 1,062,160 | 5/1913 | Kelly . | |
| 1,406,304 | 2/1922 | Vance | 211/183 X |
| 1,718,263 | 6/1929 | Summers | 312/213 X |
| 1,877,265 | 9/1932 | Chadwick | 160/354 X |
| 2,508,190 | 5/1950 | Previdi | 2/253 |
| 2,807,312 | 9/1957 | Florian | 155/127 |
| 3,018,486 | 1/1962 | Bukspan | 2/87 |
| 3,137,249 | 6/1964 | Postula et al. | 108/27 |
| 3,212,755 | 10/1965 | Liss et al. | 256/65 |
| 3,625,371 | 12/1971 | Dill | 211/153 |
| 3,730,581 | 5/1973 | Parkinson | 296/37 R |
| 3,840,901 | 10/1974 | Eyster | 2/247 |
| 4,651,355 | 3/1987 | White | 2/247 |
| 4,736,853 | 4/1988 | O'Mara | 211/88 |
| 4,779,742 | 10/1988 | Starkweather et al. | 211/88 X |
| 4,836,427 | 6/1989 | McManus | 224/224 |
| 4,884,732 | 12/1989 | Sunderland | 224/252 |
| 5,181,623 | 1/1993 | Linden et al. | 211/183 |
| 5,460,278 | 10/1995 | Schonebaum | 211/88 |

*Primary Examiner*—Ramon O. Ramirez
*Assistant Examiner*—Sarah L. Purol
*Attorney, Agent, or Firm*—Vance & Romero, P.S.

[57] ABSTRACT

This invention comprises apparatus and processes for use thereof for selectively holding, retaining, supporting, and/or securing objects upon one or more shelves, and prevent such objects from inadvertently falling therefrom. The apparatus generally comprises a flexible, elastic barrier, or barrier having a elastic membrane therein, that permits: observation and inspection of objects contained within an interior compartment or enclosure on the shelf; the barrier to be stretched and pulled aside to allow access to the compartment or enclosure; and when released, retracts back to an original position to function as a barrier that retains objects within the compartment or enclosure and prevent the inadvertent escape of such objects contained therein. Furthermore, the present invention can be used without necessarily requiring permanent alteration, modification, and/or defacement of the shelf or its adjacent cabinet structure.

20 Claims, 3 Drawing Sheets

FLEXIBLE BARRIER FOR A SHELF

COPYRIGHT NOTICE

©Copyright 1994, James R. Vance. All Rights Reserved.

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

TECHNICAL FIELD

The present invention relates to apparatus and processes for selectively retaining and securing objects on a shelf. More particularly, this invention relates to barriers positioned near or adjacent to a leading or facing edge of a shelf of a medicine cabinet, cupboard, closet, and/or bookshelf to prevent objects contained thereon from inadvertently falling therefrom.

BACKGROUND ART

It is not uncommon for objects contained upon shelves located within medicine cabinets, cupboards, closets, and bookshelves to fall therefrom. This dangerous problem is particularly acute in geographical areas that are prone to frequent earthquakes. Furthermore, persons suffering from reduced or impeded dexterity often have difficulty retrieving objects from such shelving without inadvertently knocking other objects off the shelf.

The inventor is aware that some very expensive yachts contain costly custom manufactured and specially designed cabinetry. Such cabinetry may have a slightly raised, permanently installed, rigid railing located upon the front edge of the shelves. Such railing typically has a height of one to one-half inches (1" to 1½") and forms a rigid front lip for the shelf. Such railing is usually made of wood, although it may alternatively be manufactured from brass or other rigid metals or materials.

The railing is intended to prevent objects that are sliding upon the shelf from falling therefrom when the yacht rolls and pitches in the sea or ocean. Such railing, however, is not intended to replace locked and secured cabinet doors or drawers. Any capable seaman knows that objects that are likely to fall from a shelf during a storm or rough seas must be stowed away behind a locked cabinet door, drawer, or locker.

The inventor is also aware that many refrigerators have compartments therein that form small trays or enclosures. Such trays or enclosures are universally manufactured from rigid materials, such as from metal and/or from rigid, thermoplastic.

The following patents relate to various devices or processes for retaining objects upon a tray or shelf: Florian (U.S. Pat. No. 2,807,312; issued Sep. 24, 1957); Postula et al. (U.S. Pat. No. 3,137,249; issued Jun. 16, 1964); and Liss et al. (U.S. Pat. No. 3,212,755; issued Oct. 19, 1965).

Florian ('312) discloses snap-on guards for children's high chairs that include tray portions for holding food. The guards can be attached or detached from the tray and act as a guard to retain food, dishes, toys, and the like on the tray. The guard is manufactured from a flexible transparent sheet of thin plastic material. However, the guard must be of sufficient thickness to be self-supporting. The guard is transparent so that it will not interfere with the vision of the child who may occupy the chair. The outer marginal edge of the tray is provided with a plurality of fasteners which are spaced regularly throughout the entire edge of the tray. The fasteners are shown as head-and-socket fasteners. The heads are screwed into the wood of the tray. The sockets are secured to the marginal edge of the base of the sheet.

Postula et al. ('249) discloses a reinforced wire shelf for medicine cabinets and the like. The shelf is of a composite welded wire construction, and includes a complex array of components, such as a continuous peripheral frame, and a plurality of transversely extending rods and reinforcing rods that form two trusses to reinforce the shelf against vertical bending. The shelf is also provided with a guard assembly including an upper rod member having integral legs that are welded to one of the reinforcing rods. The guard assembly also includes a central leg and a longitudinal lower rod member. The guard further reinforces the shelf to resist vertical deflection thereof.

Liss et al. ('755) discloses a magnetic guard rail for medicine cabinets and the like. The guard rail is used to help prevent accidental breakage of items contained upon a shelf within a medicine cabinet. The disclosed device is designed to be used with medicine cabinets that are fabricated from steel or include steel members. The disclosed device comprises a complex array of components including plastic front posts, an integrally formed connecting rib, body members, a nonmagnetizable shelf, rear body members, cup-shaped circular shells, permanent magnets of circular shape, a steel surface, rod or railing members that extend between the posts and slidably engage with the posts through apertures, and a resilient clip. In essence, the body members which support the guard rail are held in position on the shelf by the attractive force of attached magnets. Thus, the guard rail is held in place through the utilization of magnets.

The devices described above are significantly different from the various embodiments of the present invention as will be described below.

The inventor believes that the devices and patents cited above, whether taken alone or in combination, neither anticipate nor render obvious the present invention. The foregoing discussion does not constitute an admission that such devices and/or patents are either relevant or material to the present claims. Rather, such devices and patents relate only to the general field of the invention and are cited as constituting the closest art of which the inventor is aware.

DISCLOSURE OF INVENTION

The apparatus of the present invention is safe, functional, reliable, reusable, removable, compact, efficient, durable in design, and rugged. The invention is easily constructed, is inexpensive and economical to manufacture, and is simple to use.

The invention is very easy to install and requires a minimal amount of setup time. Installation and operation can be easily accomplished with a minimum amount of physical manipulation. Furthermore, the invention does not necessarily require the permanent piercing, defacement, mutilation, alteration, and/or modification of either the shelf or of the surrounding cabinet, cupboard, bookcase, and/or walls.

The invention provides an extremely simple, unobtrusive apparatus that requires a minimum amount of room for operation, is very compact, and if desired can be easily removed and stored after use.

The invention increases the speed and simplifies the procedure to safely and selectively secure objects positioned upon a shelf.

Unlike the previously known devices, the present invention is generally flexible, elastic, and is capable of being significantly stretched. These unique features permit the invention to perform its intended functions and be used by persons having either normal or reduced physical dexterity.

The apparatus of the present invention is generally intended to be removably secured to a front or leading edge of a shelf and to the front or leading edges of adjacent sidewalls of the cabinet, cupboard, and/or bookcase which contain the shelf. Alternatively, the apparatus may be permanently secured or installed to the cabinet, cupboard, and/or bookcase.

Within the preferred embodiment of the invention, the apparatus derives much of its structural integrity from its attachment to the front or leading edges of the shelf and adjacent sidewalls of the cabinet, cupboard, and/or bookcase. Alternatively, the apparatus of the present invention may be provided with independent means of structural integrity.

Since the invention has a thin cross-sectional profile, exterior doors that may be secured to the cabinet, cupboard, and/or bookcase, and may be juxtaposed against the invention, do not necessarily need to be modified or altered to accommodate the additional thickness of the invention. In other words, the invention does not interfere with the otherwise normal operation of the doors. Furthermore, the sparse and valuable shelf space is not taken up by an excessively thick apparatus or device.

After attachment, the present invention is employed by a user pulling an elastic membrane or barrier aside to allow easy access to the interior compartment of the shelf. In other words, the invention does not require that the user exhibit any careful or critical attention to manually part, move, or slide complex, rigid, inflexible barrier components. Instead, the user may simply, quickly, and easily pull upon the barrier to obtain access to the shelf compartment without having to exercise great concern or caution to prevent other objects from falling therefrom.

When released, the elastic membrane or barrier of the invention instantly retracts back to an original position to retain and prevent the escape of objects contained upon the shelf. The ability to selectively expand or contract as needed in three different directions further clearly distinguishes the present invention over the devices of the prior art.

If an excess number of objects are placed upon the shelf, the present invention will automatically expand to accommodate the reception of such additional objects, even if such objects exceed the volume capacity of the shelf enclosure. In essence, the invention may function as an expandable front pocket or barrier that enables the shelf to hold more objects than would otherwise be possible.

The invention may also be constructed from flexible, elastic material that permits the easy observation and inspection of objects contained within the enclosure of the shelf.

In addition to achieving the aforementioned and below described general and specific objectives, the present invention also overcomes all of the previously mentioned disadvantages.

As illustrated in the accompanying drawings and/or described below, the present invention may take several different forms or embodiments without diverting from the basic principles taught herein. For example, the apparatus of the present invention may be attached to any standard or non-standard cabinet, cupboard, bookcase, or other built-in shelving, without necessarily requiring any structural modification thereof. More particularly, use of the apparatus does not necessarily require any permanent cosmetic alterations of the cabinet, cupboard, bookcase, or other built-in shelving.

If needed, the present invention may be constructed to accommodate cabinets, cupboards, and/or bookcases having unique configurations or special dimensional demands. However, use of the present invention does not require that a special, custom-built cabinet be used.

To achieve these objectives the apparatus of the present invention generally comprises: (a) a flexible, sheet-like barrier; (b) means for imparting elastic characteristics or properties to the flexible barrier; and (c) means for securing the flexible barrier to at least two front or leading edges of a medicine cabinet, kitchen cupboard, shelving, bookcase structure, or the like.

The general concept of the present invention is to provide the front or opening of the shelf enclosure or compartment with a flexible, fence- or gate-like barrier or panel that can be pulled aside when desired. In essence, the flexible barrier is stretched across at least a portion of the opening of a shelf-like support structure.

Such panel or barrier may be manufactured from any desired fabric, leather, plastic, latex, SPANDEX, rubber, or any other composite sheet material.

Within the preferred embodiment of the invention, the front panel is manufactured from an elastic or semi-elastic, stretchable, web-like material, similar to that used in hair nets. The web-like material permits a person using the invention to look through the front panel and observe the contents contained therein. Furthermore, the elastomeric nature of the stretchable web-like material is easily pulled aside when access to the shelf enclosure is desired. The elastomeric nature of the stretchable web-like material then retracts back into a closed position to retain the contents contained within the shelf enclosure when the user releases a handheld hold on the flexible barrier.

The flexible barrier or panel may comprise any desired shape or configuration and may be manufactured in a large variety of different sizes. Within the preferred embodiment of the invention, the front panel has a simple rectangular shape that is wide enough to span across the width of a medicine cabinet and is high enough to form a flexible barrier, fence, or gate to retain items held upon a medicine cabinet shelf.

Similarly, the flexible barrier or panel may be configured and sized to fit against the front edge and a portion of each upright side of a shelf in a kitchen cabinet.

Means for securing or attaching at least a portion of the periphery of the flexible barrier or front panel to the underlying support structure are also provided. For example, if the flexible barrier or front panel has a generally rectangular shape or configuration, the bottom edge and immediately adjacent side edges of the panel may be provided with means to adhere such edges to the support structure.

Within the preferred embodiment of the invention, such adhesive attaching means is provided by removing a peel-off protective backing or covering that otherwise prevents contamination of the underlying adhesive until attachment of the apparatus is desired.

Of course, such securing or attaching means could comprise alternative mechanisms to secure the flexible barrier or front cover to the support structure. For example, the flexible barrier may be secured to a separate backboard, backing material, and/or facing mounting bracket that in turn is attached to the aforementioned support structure. When so used, such separate backboard, backing material, and/or facing mounting bracket provides additional structural integrity and strength to the apparatus.

Such backboard, backing material, and/or facing mounting bracket may be secured to the support structure by any appropriate means; for example, by means of an adhesive, clips, bands, straps, VELCRO fasteners, screws, nails, pins, and the like.

Although the preferred embodiment of the invention is primarily adapted to an "after-market" use or application, it is important to note that the present invention can also be used as "original equipment" on the aforementioned and other support structures.

The foregoing explanation is a brief summary of various aspects of the invention and is not intended as a comprehensive explanation of the claimed subject matter. Consequently, to have a more complete understanding of the claimed invention, one should review the following explanation, drawings, and appended claims. It should also be understood that all portions of the Specification and claims are incorporated herein by this reference.

These and other objectives and advantages of the present invention will become more readily apparent upon reading the following disclosure and referring to the attached drawings.

Figure 1:
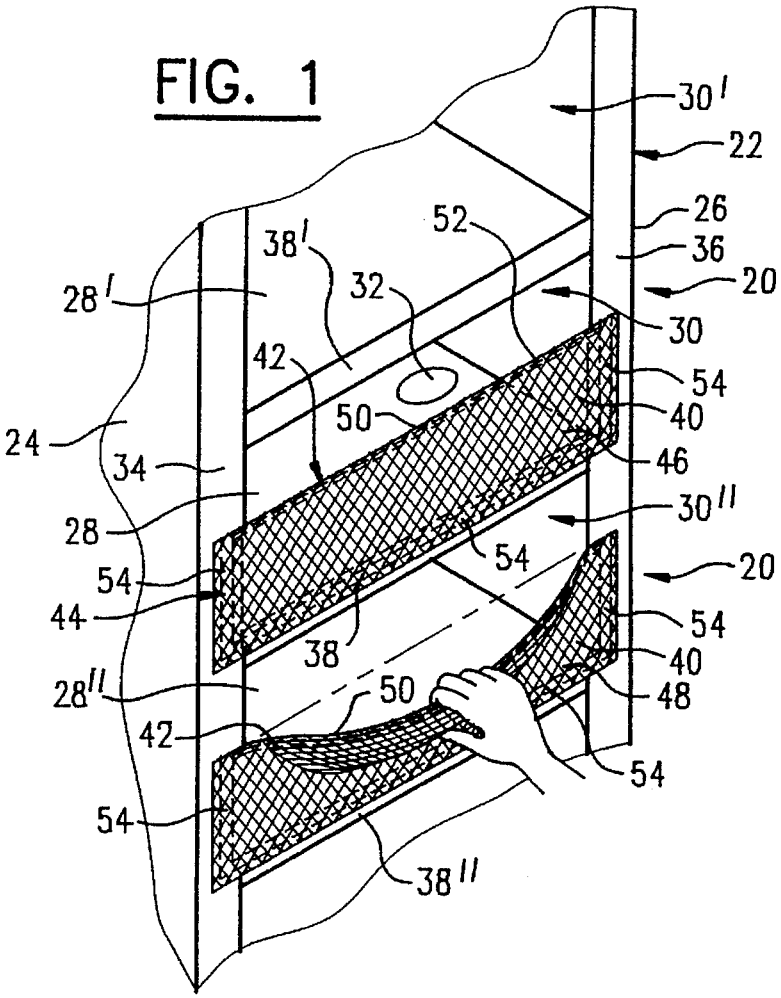
FIG. 1 is an isometric view of a first embodiment of the present invention being attached to the forward or leading edges of a shelf and sidewalls of a cabinet.

The reader should understand that the drawings are not necessarily to scale and the elements are sometimes illustrated by graphic symbols, phantom lines, diagrammatic representations, and fragmentary views. In certain instances, the inventor may have omitted details that are not necessary for an understanding of the present invention or that render other details difficult to perceive.

BEST MODE FOR CARRYING OUT THE INVENTION

Referring to the drawings, wherein like numerals indicate like parts, apparatus 20 as taught herein generally comprises an attachment for a rigid or semi-rigid structure 22.

It is intended that structure 22 will be a shelf, cabinet, cupboard, bookcase, piece of furniture, or the like. For example, within the accompanying Figures, structure 22 is illustrated as a cabinet having a first side 24, an opposed second side 26, and one or more shelves 28, 28', and 28" located therebetween. The interior side walls of first side 24 and second side 26 and the upper surface of shelves 28, 28', and 28" define a compartment or enclosure 30, 30', and 30", respectively, within which an object 32 may be held.

Of particular concern for the present invention, structure 22 has a plurality of front or leading edges 34, 36, and 38, 38' and/or 38". Leading edge 34 is defined by the front or facing edge of first side 24 when viewing compartment or enclosure 30. Leading edge 36 is defined by the front or facing edge of second side 26 when viewing compartment or enclosure 30. Leading edge 38 is defined by the front or facing edge of shelf 28 when viewing compartment or enclosure 30. Leading edge 38' is defined by the front or facing edge of shelf 28' when viewing compartment or enclosure 30'. Similarly, leading edge 38" is defined by the front or facing edge of shelf 28" when viewing compartment or enclosure 30" in FIG. 1.

It is important to note that within the preferred embodiment of the present invention apparatus 20 is secured to the front or leading edges 34, 36, and 38 of structure 22.

Alternatively, the present invention could still be practiced if apparatus 20 were secured to the interior sidewalls of first side 24, of second side 26, and of the upper surface of either shelves 28, 28', and/or 28", near or adjacent to leading edges 34, 36, and 38, 38', and/or 38".

In essence, apparatus 20 should be positioned near or adjacent to compartment or enclosures 30, 30', and/or 30".

As seen within the Figures, apparatus 20 generally comprises: (a) a flexible, sheet-like barrier 40; (b) means 42 for imparting elastic characteristics or properties to flexible barrier 40; and (c) means 44 for securing flexible barrier 40 to at least two of the front or leading edges 34, 36, and/or 38, 38' and/or 38" of structure 22. Each of these elements will be discussed in the order that they were just introduced.

Flexible barrier 40 of apparatus 20 generally comprises a sheet material that is capable of retaining object 32 within enclosure 30, 30', and/or 30", and preventing object 32 from inadvertently falling or escaping therefrom.

Within the preferred embodiment of the invention, flexible barrier 40 is manufactured from a material that also permits the observation and/or inspection of object 32 that is contained within the compartment or enclosure 30, 30', and/or 30". Furthermore, within the preferred embodiment of the invention such observation and/or inspection can be made without flexible barrier 40 necessarily being moved from a closed position illustrated in FIG. 1 by reference numeral 46 to an open position illustrated in FIG. 1 by reference numeral 48.

More particularly, flexible barrier 40 may be manufactured from a flexible transparent and/or translucent sheet material such as plastic.

Within the preferred embodiment of the invention, however, flexible barrier 40 is manufactured from an elastic flexible net material having a plurality of holes or openings therein which allow for observation and/or inspection of object 32 contained within enclosure 30, 30', and/or 30". Such net material can be readily found within the marketplace.

Flexible barrier 40 may further be manufactured from materials having a wide variety of different colors. Such colors can be used to indicate particular types of objects 32 contained within the enclosures 30, 30', and/or 30". This "color-coding" feature can be particularly helpful within a medical, dental, and/or laboratory environment wherein the sorting and placement of such objects 32 can be crucial, if not life threatening. The "color-coding" feature of flexible barrier 40 can also be used to match designer colors of particular cabinets, kitchens, bathrooms, and/or office environments.

Elastic means 42 as discussed above is attached to or incorporated within flexible barrier 40. Elastic means 42 generally enables flexible barrier 40 to be stretched, deformed, and pulled at least partially aside to move flexible barrier 40 from its closed position 46 to its open position 48. While flexible barrier 40 is held in its open position 48, object 32 may be removed from within enclosure 30, 30", and/or 32", or object 32 may be placed therein.

Once the forces that moved flexible barrier 40 from its closed position 46 to its open position 48 are removed, elastic means 42 urges flexible barrier 40 to return to its closed position 46. Consequently, when flexible barrier 40 returns to its closed position 46, object 32 that is contained within enclosure 30, 30', and/or 30" is prevented from inadvertently falling therefrom.

Within the preferred embodiment of the invention, elastic means 42 is incorporated integrally within the flexible net material of flexible barrier 40. This type of material can often be found in some elastic hair net products.

Additionally and/or alternatively, elastic means 42 may comprise an elongated length of elastic material or cord 50 that is attached to or incorporated within flexible barrier 40. For example, FIG. 2 clearly illustrates the elongated length of elastic material or cord 50 as being generally attached to or incorporated within an upper edge 52 of flexible barrier 40. Of course, elastic material or cord 50 can be positioned at other locations within flexible barrier 40, and even form straight, parallel, crisscrossing, diamond-shaped, and other patterns within the fabric of flexible barrier 40.

Within the preferred embodiment of the invention, securing means 44 generally comprises at least one elongated length of adhesive 54 that is applied to at least two of front or leading edges 34, 36, and 38, 38' or 38" of structure 22. When flexible barrier 40 is juxtaposed and pressed against the length of adhesive 54, such adhesive 54 at least temporarily secures flexible barrier 40 to at least two or more of front or leading edges 34, 36, and 38, 38' or 38" of structure 22.

A wide variety of different adhesives are currently available upon the market. It is the intention of the inventor to use an adhesive 54 that accomplishes the aforementioned task of securing flexible barrier 40 to structure 22, without requiring permanent alteration, modification, or defacement of structure 22.

Additionally and/or alternatively, securing means 44 may comprise at least one elongated length of a hook and loop fastener system 56, such as the product being commonly sold under the trademark VELCRO. It should be kept in mind that many VELCRO hook and loop fastener systems are manufactured with a peel-off wax paper backing that when removed exposes an already applied length of adhesive 54. Since the hook and loop fastener system 56 is nearly identical to that of adhesive 54, and function in a similar way, both are simultaneously illustrated within FIG. 2. A separate drawing for the VELCRO hook and loop fastener system 56 is not believed to be necessary for a clear understanding of the applicant's invention.

Figure 2:
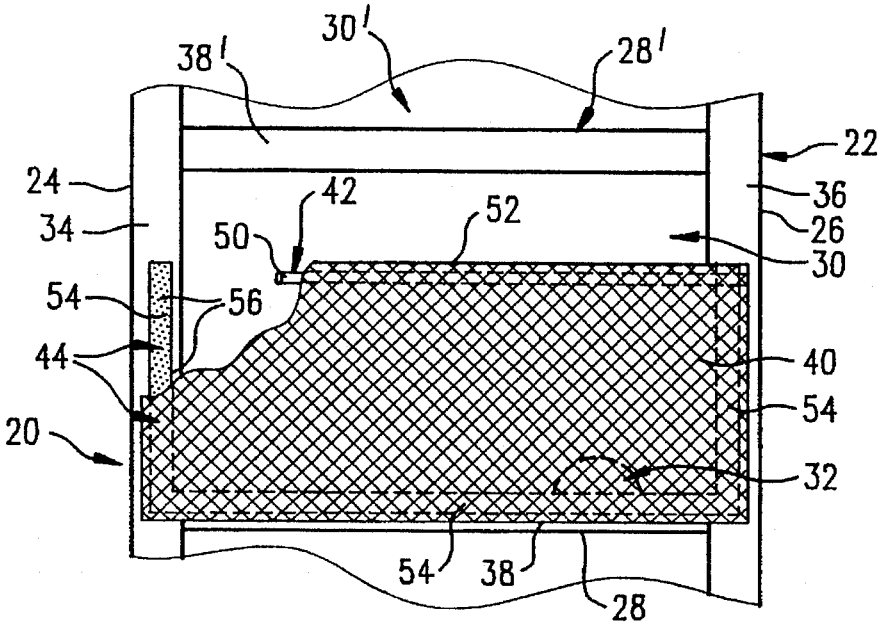
FIG. 2 is a partial or fragmentary, side elevational view of the apparatus illustrated in FIG. 1.

As seen in FIG. 2, if the hook and loop fastener system 56 is used, such elongated lengthens thereof should be applied to at least two of the front or leading edges 34, 36, and 38, 38' or 38" of structure 22. Use of the hook and loop fastener system 56 permits the at least temporarily securement of flexible barrier 40 to at least two of the front or leading edges 34, 36, and 38, 38' or 38" of structure 22.

Figure 3:
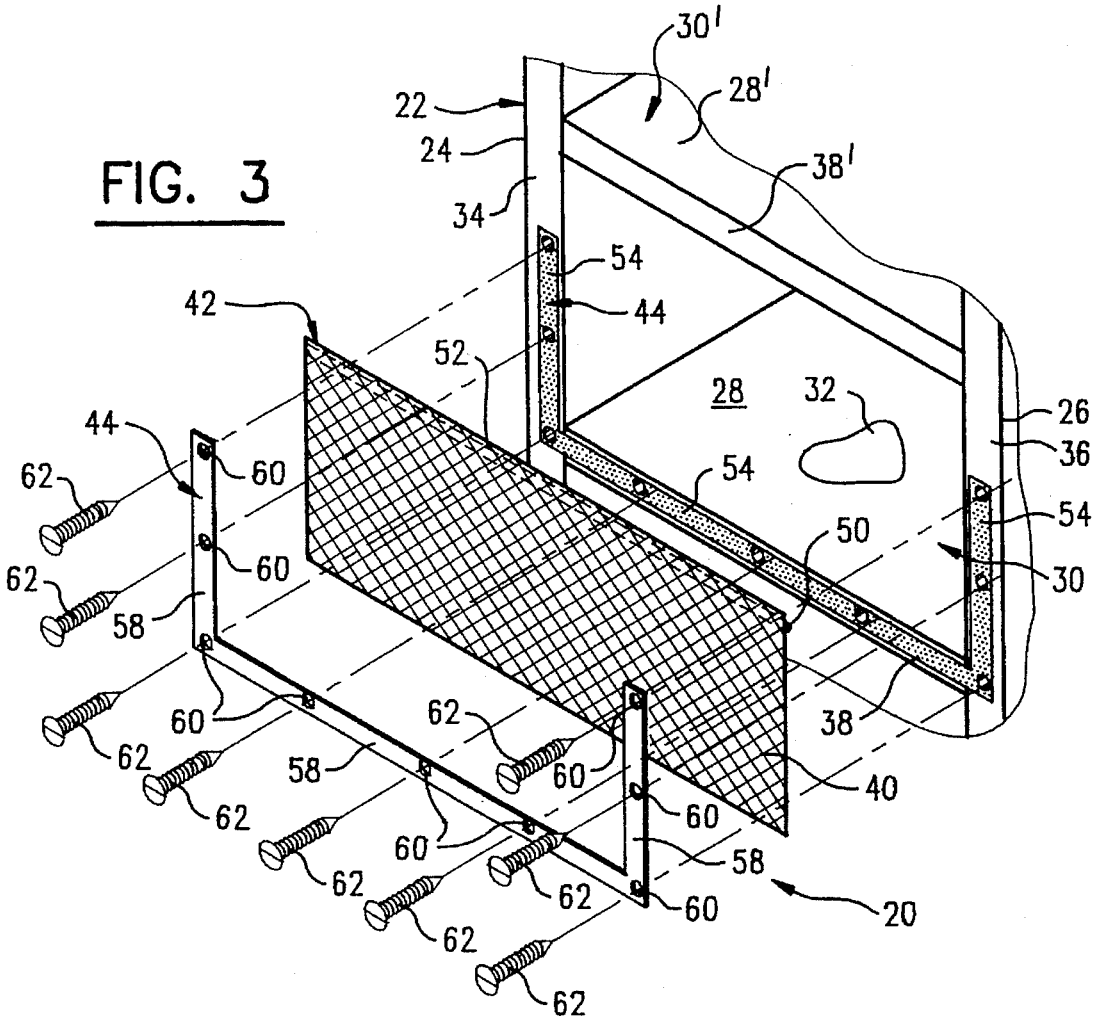
FIG. 3 is an enlarged, exploded, isometric view of a second embodiment of the present invention, wherein a mounting bracket is also used to provide added structural integrity and support to the apparatus.

FIG. 3 illustrates another embodiment of the present invention, wherein securing means 44 additionally and/or alternatively comprises at least one mounting bracket 58. Mounting bracket 58 can be adhesively and/or mechanically secured to at least two or more of the front or leading edges 34, 36, and 38, 38' or 38" of structure 22. If mounting bracket 58 is used, flexible barrier 40 is preferably at least partially juxtaposed between mounting bracket 58 and at least two or more of the front or leading edges 34, 36, and 38, 38' or 38" of structure 22. It should be noted that the use of mounting bracket 58 provides flexible barrier 40 with added structural support.

Figure 4:
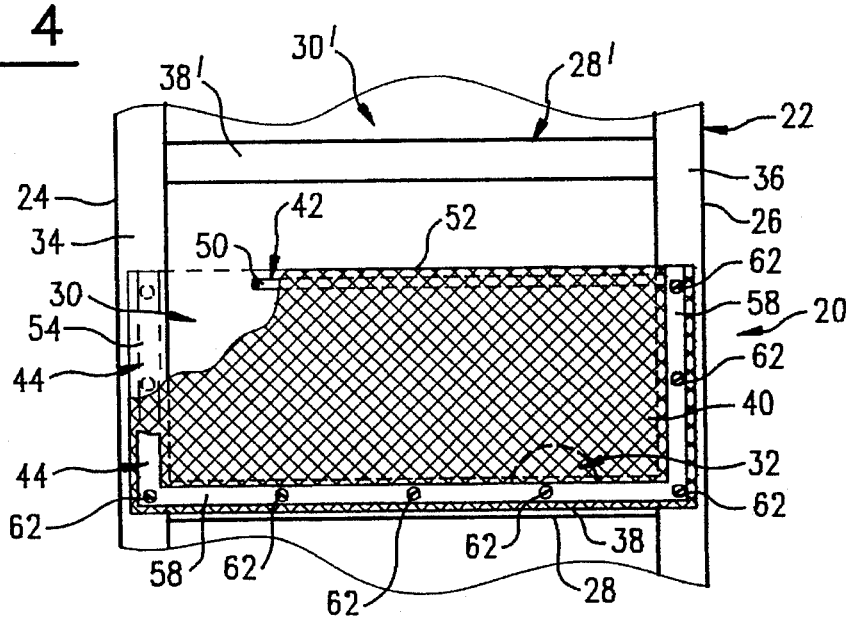
FIG. 4 is a partial or fragmentary, side elevational view of the apparatus illustrated in FIG. 3.

As readily seen within FIG. 3, mounting bracket 58 can be provided with one or more bores 60 or bore holes located therein, through which a fastener 62, such as a screw, bolt, nail, tack, staple, peg, or pin, may pass. In essence, fasteners 62 secure mounting bracket 58 and flexible barrier 40 to the front or leading edges 34, 36, and 38, 38' or 38" of structure 22. FIG. 4 illustrates the mounting bracket 58 and flexible barrier 40 thus secured by fasteners 62.

It should be remembered that mounting bracket 58 may also be adhesively and mechanically secured to structure 22. Within such an embodiment, flexible barrier 40 is preferably at least partially juxtaposed between the mounting bracket 58 and the strip of adhesive 54. The strip of adhesive 54 is applied directly to two or more front or leading edges 34, 36, and 38, 38' or 38" of structure 22.

Figure 5:
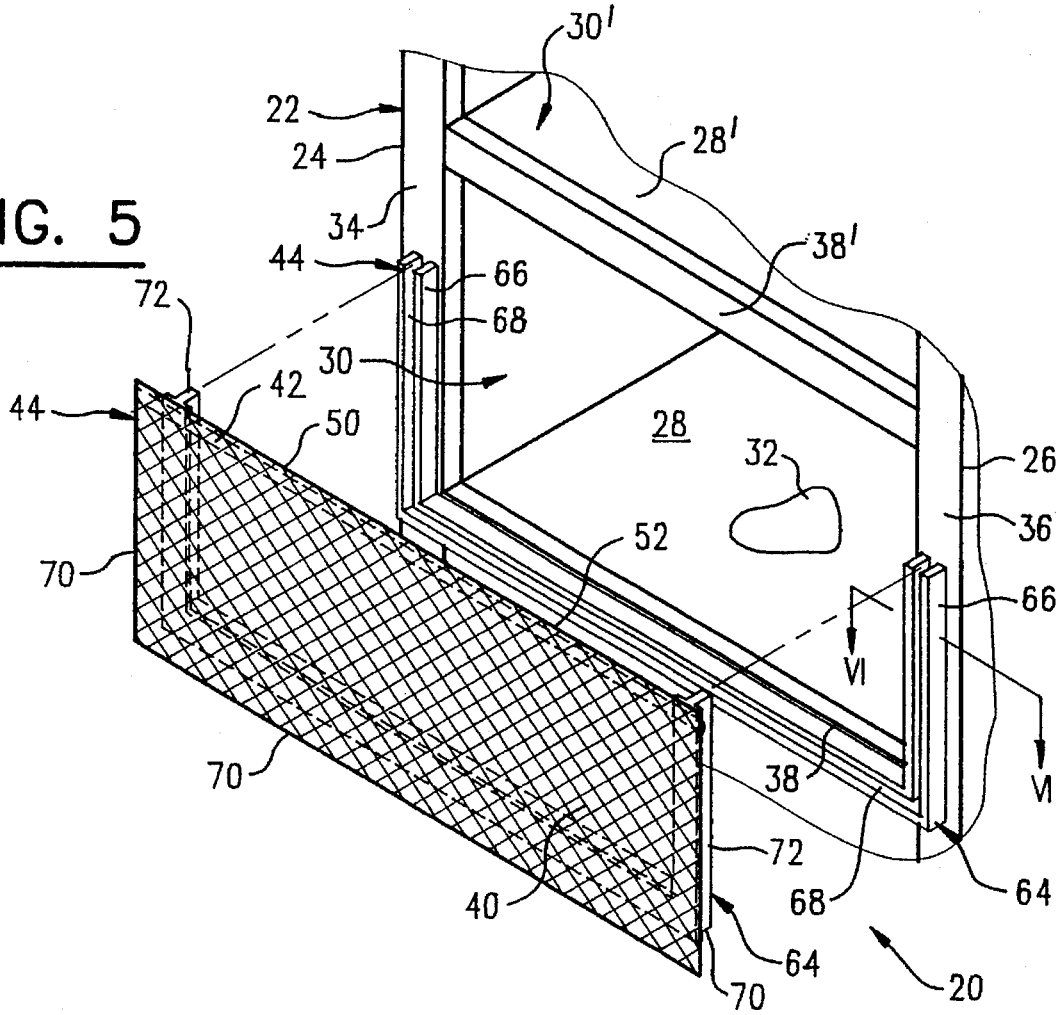
FIG. 5 is an enlarged, exploded, isometric view of a third embodiment of the present invention, wherein a two-piece, channel-mating mounting bracket is used to provide additional structural integrity and support to the apparatus.
Figure 6:
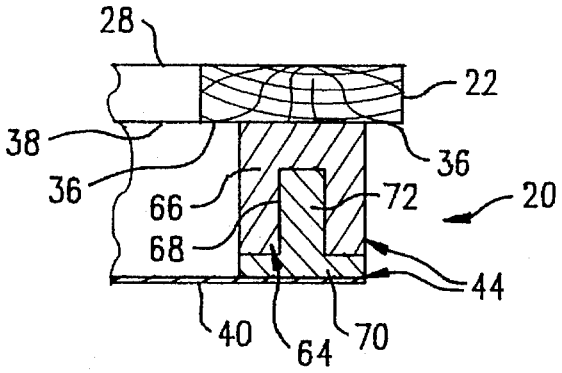
FIG. 6 is an enlarged, partial or fragmentary, cross-sectional, top plan view as seen from a plane defined by line VI—VI in FIG. 5 illustrating the interlocked, two-piece, channel-mating mounting bracket.

FIGS. 5 and 6 illustrate an even further embodiment of the present invention, wherein securing means 44 comprises at least a two-piece, channel-mating mounting bracket 64. The channel-mating mounting bracket 64 generally comprises: (a) a first portion 66 having a channel 68 located longitudinally therein; and (b) a second portion 70 having a flange 72 that is insertable into and mated with channel 68.

Channel-mating mounting bracket 64 may be adhesively and/or mechanically secured to flexible barrier 40 and/or to at least two or more of the front or leading edges 34, 36, and 38, 38' or 38" of structure 22. Similar to mounting bracket 58, channel-mating mounting bracket 64 also provides flexible barrier 40 with added structural support.

As illustrated within FIGS. 5 and 6, when this embodiment is used, the inventor prefers to at least partially adhere flexible barrier 40 to an exterior or outer surface of second portion 70. First portion 68 may be adhesively and/or mechanically secured to structure 22 as previously discussed above.

One of the added benefits of using channel-mating mounting bracket 64, is that first portion 66 may be removably secured to second portion 70 which allows for easy separation for periodic cleaning and/or replacement.

The reader should be aware that securing means 44 need only secure flexible barrier 40 to two of the front or leading edges 34, 36, and 38, 38' or 38" of structure 22. For example, two opposed sides of flexible barrier 40 can be secured to structure 22. Alternatively, two immediately adjacent sides of flexible barrier 40 can be secured to structure 22.

Although such construction of the invention is contemplated herein, the inventor prefers that flexible barrier 40 be supported on three sides thereof, namely on each opposed side adjacent to the first and second sides 24 and 26, respectively, and along the bottom edge of flexible barrier 40 adjacent to shelf 28.

The means and construction disclosed herein are by way of example and comprise primarily the preferred and alternative forms of putting the invention into effect. Although the drawings depict a preferred and two different alternative embodiments of the invention, other embodiments have been described within the preceding text. One skilled in the art may appreciate that the disclosed apparatus may have a wide variety of different shapes and configurations. Additionally, persons skilled in the art to which the invention pertains might consider the foregoing teachings in making various modifications, other embodiments, and alternative forms of the invention.

It is, therefore, to be understood that the invention is not limited to the particular embodiments or specific features shown herein. To the contrary, the inventor claims the invention in all of its forms, including all alternatives, modifications, equivalents, and alternative embodiments that fall within the legitimate and valid scope of the appended claims, appropriately interpreted under the Doctrine of Equivalents.

INDUSTRIAL APPLICABILITY

The present invention may be used within industries that manufacture and/or provide cabinetry and related accessories for: hospitals, medical clinics, dental offices, laboratory facilities, household medicine cabinets, kitchen cabinets, boat and recreational vehicle cabinetry, office shelving, book shelving, furniture that contain entertainment and personal computer equipment, and the like. Such cabinetry can be initially constructed to incorporate the use of the present invention. Additionally and/or alternatively, the present invention may be applied to pre-existing cabinetry and furniture to meet an after-market demand for the invention.

In essence, the present invention may be used anywhere simple, reliable, easily used, inexpensive apparatus and processes are needed to selectively hold, retain, support, and secure objects upon a shelf, and prevent such objects from inadvertently falling therefrom. The apparatus of this invention is durable in design, easily constructed, inexpensive and economical to manufacture, compact, functional, unobtrusive, efficient, reusable, rugged, adjustable, is extremely simple to use, and is collapsible for easy storage when not used. The present invention not only simplifies the apparatus and procedure to retain objects upon a shelf, it also provides an apparatus that does not necessarily require the piercing, alteration, or modification of the cabinet, cupboard, bookcase, or shelf. The present invention can also be folded or collapsed into an extremely flat, compact state for storage when not being used.

I claim:

1. An apparatus for attachment to a rigid or semi-rigid structure, such as to a shelf, cabinet, cupboard, bookcase, or piece of furniture, that defines a compartment or enclosure within which an object may be held, the structure having a plurality of front or leading edges thereof positioned adjacent to the compartment or enclosure, said apparatus comprising:

(a) a flexible, sheet-like barrier;

(b) means for imparting elastic characteristics or properties to said flexible barrier, said elastic means being attached to or incorporated within said flexible barrier; and (c) means for securing said flexible barrier to at least two of the front or leading edges of the structure, said elastic means enabling said flexible barrier to be stretched and pulled at least partially aside to an open position whereby the object may be removed from within the compartment or enclosure or be placed therein; said elastic means urging said flexible barrier to return to a closed position to prevent the object from inadvertently falling from the compartment or enclosure.

2. The apparatus of claim 1, wherein said flexible barrier comprises a material that permits observation or inspection of the object within the compartment or enclosure without the flexible barrier necessarily being moved to said open position.

3. The apparatus of claim 2, wherein said flexible barrier comprises a flexible net material.

4. The apparatus of claim 3, wherein said elastic means is incorporated integrally within said flexible net material.

5. The apparatus of claim 2, wherein said flexible barrier comprises a flexible transparent or translucent sheet material.

6. The apparatus of claim 1, wherein said elastic means comprises an elongated length of elastic material attached to or incorporated within said flexible barrier.

7. The apparatus of claim 6, wherein said elongated length of elastic material is generally attached to or incorporated within an upper edge of said flexible barrier.

8. The apparatus of claim 1, wherein said securing means comprises at least one elongated length of adhesive that is applied to at least two of the front or leading edges of the structure, said length of adhesive at least temporarily securing said flexible barrier to at least two of the front or leading edges of the structure.

9. The apparatus of claim 1, wherein said securing means comprises at least one elongated length of a hook and loop fastener system that is applied to at least two of the front or leading edges of the structure, said hook and loop fastener system at least temporarily securing said flexible barrier to at least two of the front or leading edges of the structure.

10. The apparatus of claim 1, wherein said securing means comprises at least one mounting bracket that is adhesively or mechanically secured to at least two of the front or leading edges of the structure, said flexible barrier generally being at least partially juxtaposed between said mounting bracket and at least two of the front or leading edges of the structure, said mounting bracket providing said flexible barrier with added structural support.

11. The apparatus of claim 10, wherein said mounting bracket is provided with at least one bore through which a fastener, such as a screw, bolt, nail, tack, staple, peg, or pin, may pass, said fastener securing said mounting bracket to the structure.

12. The apparatus of claim 10, wherein said securing means comprises at least one mounting bracket that is adhesively and mechanically secured to at least two of the front or leading edges of the structure, said flexible barrier generally being at least partially juxtaposed between said mounting bracket and at least one elongated length of adhesive that is applied to at least two of the front or leading edges of the structure.

13. The apparatus of claim 1, wherein said securing means comprises at least a two-piece, channel-mating mounting bracket, said channel-mating mounting bracket having a first portion having a channel therein, said channel-mating mounting bracket having a second portion having a flange that is insertable into and mated with said channel, said channel-mating mounting bracket adhesively or mechanically securing said flexible barrier to at least two of the front or leading edges of the structure, said channel-mating mounting bracket providing said flexible barrier with added structural support.

14. The apparatus of claim 13, wherein said second portion is removably secured to said first portion of said channel-mating mounting bracket.

15. The apparatus of claim 13, wherein said flexible barrier is at least partially adhered to said second portion of said channel-mating mounting bracket.

16. The apparatus of claim 13, wherein said first portion of said channel-mating bracket is adhesively or mechanically secured to at least two of the front or leading edges of the structure.

17. The apparatus of claim 1, wherein said securing means secures said flexible barrier to at least two immediately adjacent front or leading edges of the structure.

18. The apparatus of claim 1, wherein said securing means secures said flexible barrier to at least three of the front or leading edges of the structure.

19. The apparatus of claim 18, wherein said securing means secures said flexible barrier to at least three immediately or successively adjacent front or leading edges of the structure.

20. The apparatus of claim 1, wherein said securing means secures said flexible barrier to at least two of the front or leading edges of the structure without requiring permanent alteration, modification, or defacement of the structure.

* * * * *